US010508329B2

(12) United States Patent
Horikawa et al.

(10) Patent No.: US 10,508,329 B2
(45) Date of Patent: Dec. 17, 2019

(54) ALUMINUM ALLOY MATERIAL FOR USE IN THERMAL CONDUCTION APPLICATION

(71) Applicant: Nippon Light Metal Company, Ltd., Tokyo (JP)

(72) Inventors: Hiroshi Horikawa, Tokyo (JP); Masahiko Shioda, Tokyo (JP)

(73) Assignee: Nippon Light Metal Company, Ltd., Tokyo (JP)

( * ) Notice: Subject to any disclaimer, the term of this patent is extended or adjusted under 35 U.S.C. 154(b) by 0 days.

(21) Appl. No.: 14/057,296

(22) Filed: Oct. 18, 2013

(65) Prior Publication Data

US 2014/0048186 A1 Feb. 20, 2014

Related U.S. Application Data

(62) Division of application No. 12/527,283, filed as application No. PCT/JP2007/053612 on Feb. 27, 2007, now Pat. No. 9,353,429.

(51) Int. Cl.

| | |
|---|---|
| ***C22F 1/043*** | (2006.01) |
| ***C22C 21/02*** | (2006.01) |
| ***F28F 21/08*** | (2006.01) |
| *F28D 21/00* | (2006.01) |

(52) U.S. Cl.

CPC ..... *C22F 1/043* (2013.01); *C22C 21/02* (2013.01); *F28F 21/084* (2013.01); *F28D 2021/0029* (2013.01)

(58) Field of Classification Search

CPC ..... C22F 1/043
USPC ..... 148/699, 549, 698, 700
See application file for complete search history.

(56) References Cited

U.S. PATENT DOCUMENTS

| | | | | |
|---|---|---|---|---|
| 4,786,340 | A | 11/1988 | Ogawa et al. | |
| 5,749,980 | A | 5/1998 | Izuchi et al. | |
| 7,625,454 | B2 | 12/2009 | Lin et al. | |
| 8,409,374 | B2 * | 4/2013 | Lumley et al. | 148/549 |
| 2003/0180178 | A1 | 9/2003 | Szymanowski et al. | |
| 2004/0045638 | A1 | 3/2004 | Garat | |
| 2005/0163647 | A1 * | 7/2005 | Donahue et al. | 420/537 |
| 2005/0167012 | A1 * | 8/2005 | Lin | C22F 1/043 148/549 |
| 2005/0191204 | A1 * | 9/2005 | Lin et al. | 420/531 |
| 2005/0199318 | A1 | 9/2005 | Doty | |
| 2007/0125460 | A1 | 6/2007 | Lin | |

FOREIGN PATENT DOCUMENTS

| | | | |
|---|---|---|---|
| EP | 0 531 118 | A1 | 3/1993 |
| EP | 1 736 561 | A1 | 12/2006 |
| JP | 5-65586 | A | 3/1993 |
| JP | 09-324234 | A | 12/1997 |
| JP | 2001-316748 | A | 11/2001 |
| JP | 2001-335872 | A | 12/2001 |
| JP | 2002-003972 | A | 1/2002 |
| JP | 2002-105571 | A | 4/2002 |
| JP | 2004-217953 | A | 8/2004 |
| JP | 2005-298856 | A | 10/2005 |
| JP | 2006-063420 | A | 3/2006 |
| WO | 2005/098065 | A1 | 10/2005 |
| WO | 2006/066314 | A1 | 6/2006 |

OTHER PUBLICATIONS

"Aluminum and Aluminum Alloys", edited by J.R. Davis, ASM Specialty Handbook dated 1993.
Response to Office action dated Dec. 19, 2011, in U.S. Appl. No. 11/793,023 (Lumley et al., U.S. Pat. No. 8,409,374), pp. 1-8.
Response to Office action dated Sep. 4, 2012, in U.S. Appl. No. 11/793,023 (Lumley et al., U.S. Pat. No. 8,409,374), pp. 1-6.

* cited by examiner

*Primary Examiner* — George Wyszomierski
*Assistant Examiner* — Janell C Morillo
(74) *Attorney, Agent, or Firm* — Pearne & Gordon LLP

(57) ABSTRACT

An aluminum alloy material for use in thermal conduction to which improved castability has been imparted by silicon addition. It has improved thermal conductivity and improved strength. The material has a composition containing 7.5-12.5 mass % Si and 0.1-2.0 mass % Cu, the remainder being Al and unavoidable impurities, wherein the amount of copper in the state of a solid solution in the matrix phase is regulated to 0.3 mass % or smaller. The composition may further contain at least 0.3 mass % Fe and/or at least 0.1 mass % Mg, provided that the sum of (Fe content) and (content of Mg among the impurities)×2 is 1.0 mass % or smaller and the sum of (Cu content), (content of Mg among the impurities)×2.5, and (content of Zn among the impurities) is 2.0 mass % or smaller.

2 Claims, No Drawings

ALUMINUM ALLOY MATERIAL FOR USE IN THERMAL CONDUCTION APPLICATION

This application is a divisional of U.S. patent application Ser. No. 12/527,283 filed on Aug. 14, 2009, which is incorporated herein by reference in its entirety.

TECHNICAL FIELD

The present invention relates to an aluminum alloy material for use in a thermal conduction application and a process of production thereof. The aluminum alloy material for use in a thermal conduction application according to the present invention may, for example, be suitably used in heat sinks of complicated shape or heat sinks having thin portions in order to increase the heat dissipation. Therefore, the present invention also relates to heat exchange members, for example, heat dissipating members such as heat sinks.

BACKGROUND ART

In recent years, advances in electronic devices have resulted in a demand for compact and lightweight heat sinks particularly excelling in heat dissipation, for which heat sinks must be made thinner and in complicated shapes. On the other hand, aluminum alloys generally have a higher thermal conductivity with a higher aluminum purity level. Hence, when requiring high thermal conductivity, one might contemplate using pure aluminum, but pure aluminum has poor strength and is difficult to cast, so it has not been possible to cast any in complicated shapes or having thin portions.

Thus, when producing a heat sink having a complicated shape or a thin portion, such as described in JP 2001-316748A, JP 2002-3972A or JP 2002-105571A, an aluminum alloy containing Si is used to improve the castability even at the cost of sacrificing some of the thermal conductivity.

While these conventional alloys are alloys having Si and Fe added to aluminum, the content of elements such as Cu, Mn, Zn and Mg that are normally contained in aluminum alloys is limited in order to prevent the thermal conductivity of the alloys from decreasing. As a consequence, the strength of the alloys can be inadequate, so that the cast articles can deform or break when separating them from the mold after casting, thus resulting in low productivity. Additionally, the poor strength causes burrs to easily form during post-processing such as cutting, and screw holes and the like can have inadequate strength. Furthermore, since the use of scrap is restricted and the raw material of the alloy ingots is limited, the alloys perform poorly in economic terms and in environmental terms especially in view of recycling, as compared with common die casting materials such as alloy JIS-ADC12.

In order to solve the above-indicated problem relating to the strength of the alloy material, the alloy materials described in JP 2005-298856A and JP 2006-63420A have been proposed.

These conventional alloy materials are alloy materials obtained by subjecting an alloy composed of aluminum with Si and Fe, with Mg further added, to a heat treatment, and they are capable of improving the strength without greatly reducing the thermal conductivity of the alloy material, by restricting the content of elements such as Cu, Mn and Zn that are usually contained in aluminum alloys. Therefore, they perform poorly in economic terms and in environmental terms especially in view of recycling, as mentioned above. Additionally, they cannot easily share melt furnaces with common die casting materials such as alloy JIS-ADC12, and therefore must be provided with special melting and casting equipment.

Patent Document 1: JP 2001-316748A
Patent Document 2: JP 2002-3972A
Patent Document 3: JP 2002-105571A
Patent Document 4: JP 2005-298856A
Patent Document 5: JP 2006-63420A

DISCLOSURE OF THE INVENTION

Problems to be Solved by the Invention

With a view to solving the above-described problems of the conventional art, the present invention has the purpose of offering an aluminum alloy material for use in a thermal conduction application with Si added to improve castability, in addition to improved strength and thermal conductivity, as well as economic and environmental performance.

Additionally, the present invention has the purpose of offering a method of manufacturing the above aluminum alloy material and a heat exchange member using the above aluminum alloy material.

Means for Solving the Problems

In order to address the above-described problems, the present applicant proposes the first through seventh aspects of the invention described below.

In a first aspect of the invention, there is provided an aluminum alloy material for use in a thermal conduction application, consisting of 7.5 to 12.5 mass % of Si, 0.1 to 2.0 mass % of Cu, and Al and unavoidable impurities as the remainder, wherein the solid solution content of Cu in the matrix phase is 0.3 mass % or less.

Here, "thermal conduction application" includes all applications for which those skilled in the art can contemplate use of aluminum alloy materials excelling in thermal conductivity, especially aluminum alloy materials having a thermal conductivity of at least 150 W/mK, including, for example, applications to heat exchange components, such as various types of heat-dissipating elements, particularly heat sinks In a second aspect of the invention, there is provided an aluminum alloy material for use in a thermal conduction application of the first aspect of the invention, further comprising at least 0.3 mass % of Fe, wherein the relationship between the Fe content and the content of Mn included as an unavoidable impurity is such that the total of (Fe content)+(Mn content)×2 is 1.0 mass % or less.

In a third aspect of the invention, there is provided an aluminum alloy material for use in a thermal conduction application of the first or second aspect of the invention, further comprising at least 0.1 mass % of Mg, wherein the relationship between the Mg content and the content of Zn included as an unavoidable impurity is such that the total of (Cu content)+(Mg content)×2.5+(Zn content) is 2.0 mass % or less.

The aluminum alloy materials of the first through third aspects of the inventions described above, as will be supported by examples to be described below, have a high thermal conductivity of at least 150 W/mK and a high mechanical strength of at least 175 MPa, and are aluminum casting materials excelling in both castability and general usefulness.

A fourth aspect of the invention proposed by the present applicant is a method of producing an aluminum alloy material for use in a thermal conduction application, comprising subjecting an aluminum alloy with the composition of any of the first to third aspects of the inventions to an ageing treatment. In other words, the fourth aspect of the invention is a method of producing an aluminum alloy material for use in a thermal conduction application, comprising subjecting to an ageing treatment one of the following aluminum alloys:

(1) an aluminum alloy consisting of 7.5 to 12.5 mass % of Si, 0.1 to 2.0 mass % of Cu, and Al and unavoidable impurities as the remainder;

(2) an aluminum alloy consisting of 7.5 to 12.5 mass % of Si, 0.1 to 2.0 mass % of Cu, at least 0.3 mass % of Fe, and Al and unavoidable impurities as the remainder, wherein the relationship between the Fe content and the content of Mn included as an unavoidable impurity is such that the total of (Fe content)+(Mn content)×2 is 1.0 mass % or less;

(3) an aluminum alloy consisting of 7.5 to 12.5 mass % of Si, 0.1 to 2.0 mass % of Cu, at least 0.1 mass % of Mg, wherein the relationship between the Mg content and the content of Zn included as an unavoidable impurity is such that the total of (Cu content)+(Mg content)×2.5+(Zn content) is 2.0 mass % or less; or (4) an aluminum alloy consisting of 7.5 to 12.5 mass % of Si, 0.1 to 2.0 mass % of Cu, at least 0.3 mass % of Fe, at least 0.1 mass % of Mg, and Al and unavoidable impurities as the remainder, wherein the relationship between the Fe content and the content of Mn included as an unavoidable impurity is such that the total of (Fe content)+(Mn content)×2 is 1.0 mass % or less, and the relationship between the Mg content and the content of Zn included as an unavoidable impurity is such that the total of (Cu content)+(Mg content)×2.5+(Zn content) is 2.0 mass % or less.

In a fifth aspect of the invention, there is provided a method of producing an aluminum alloy material for use in a thermal conduction application of the fourth aspect of the invention, wherein said ageing treatment comprises holding said aluminum alloy at a temperature of 160 to 370° C. for 1 to 20 hours.

In a sixth aspect of the invention, there is provided a method of producing an aluminum alloy material for use in a thermal conduction application of the fourth or fifth aspect of the invention, wherein before said ageing treatment, said aluminum alloy is subjected to a solution treatment by holding at a temperature of 450 to 520° C. for 1 to 10 hours, then quenched by cooling at a cooling rate of at least 100° C./sec to a temperature of 100° C. or less.

As will be supported by examples to be described below, the thermal conductivity and mechanical strength of the aluminum alloy material of the present invention can be further improved by subjecting aluminum alloys of prescribed compositions to an ageing treatment or to a solution treatment and ageing treatment.

While the aluminum alloy materials for use in thermal conduction applications according to the first to third aspects of the invention can be used for any application for which those skilled in the art contemplate a use for aluminum alloy materials excelling in thermal conductivity, they are preferably used in applications to heat exchange elements, such as various types of heat-dissipating elements, particularly heat sinks, as mentioned above.

As such, the seventh aspect of the invention is a heat exchange element consisting of the aluminum alloy material of any one of the first to third aspects of the inventions. Additionally, the eighth aspect of the invention is a heat exchange element which is a heat dissipating element.

Effects of the Invention

According to the present invention, an aluminum alloy element excelling in thermal conductivity and mechanical strength is obtained, and in particular, a thermal conductivity of at least 150 W/mK and a mechanical strength of at least 175 MPa can be achieved. Such aluminum alloy materials can be favorably used in the production of heat sinks or the like having complicated shapes or thin portions, by taking advantage of the property of aluminum alloys of excelling in castability. As a result, it is possible to obtain heat exchange elements excelling in heat exchange properties, particularly heat dissipating elements such as heat sinks.

BEST MODES FOR CARRYING OUT THE INVENTION

In an Al—Si type aluminum alloy, Cu has the function of improving the mechanical strength but also reduces thermal conductivity, so it was thought that the Cu content should preferably be made as low as possible in casting materials requiring high thermal conductivity.

However, as a result of diligent research, the inventors of the present application discovered that decreases in thermal conductivity can be suppressed even when Cu, which has conventionally been avoided in thermally conductive alloys, is added, by suppressing the amount of Cu solid solution in the matrix phase. That is, they discovered that, in the case of the alloy composition of the present invention, it is possible to obtain high thermal conductivity by adding Cu in a range of 0.1-2.0 mass %, appropriately controlling the amounts of the remaining elements, performing a heat treatment, and limiting the amount of Cu solid solution in the matrix phase to 0.3 mass % or less.

Thus, the present invention provides an aluminum alloy casting material that achieves high thermal conductivity while also being improved in other properties such as strength, by adding 0.1 to 2.0 mass % of Cu to an Al—Si aluminum alloy and limiting the amount of Cu solid solution to 0.3 mass % or less.

The effects of the composition shall be explained briefly below.

(Si: 7.5-12.5 Mass %)

Si has the function of improving castability. When casting objects such as heat sinks that have complicated shapes or thin portions, it is necessary to add at least 7.5 mass % of Si, and even better castability can be achieved by adding at least 9.0 mass %, with a view to achieving castability that is at least as good as common die casting materials. Si also has a function of improving mechanical strength, wear resistance and vibration prevention. However, increased levels of Si will reduce the thermal conductivity and ductility, so that the plastic workability will be inadequate and primary crystal Si can form to reduce the cuttability if the amount of Si is in excess of 12.5 mass %, so the amount must be kept at 12.5 mass % or less, and reductions in plastic workability and cuttability can be further suppressed by setting it to 12.0 mass % or less.

(Cu: 0.1-2.0 Mass %, Solid Solution Amount 0.3 Mass % or Less)

Cu improves the mechanical strength of aluminum alloys, and also has the function of improving the weldability of the melting tip when casting by a die-casting process. This effect becomes pronounced when 0.1 mass % or more of Cu is included, and becomes even greater at 0.5 mass % or more. Additionally, since Cu is contained in much product scrap and cast alloys, it often comes intermixed as an impurity, so a high tolerance for Cu enables the amount of scrap that can be used as the raw material to be increased, which is favorable for recycling and thus has economical and environmental benefits. However, increased Cu is accompanied by reduced thermal conductivity, and when the content exceeds 2.0 mass %, the thermal conductivity becomes insufficient. Additionally, while increases in Cu will increase the amount of Cu solid solution in the matrix phase, the thermal conductivity will vary with the amount of solid solution, and the thermal conductivity will be inadequate if the Cu solid solution content exceeds 0.3 mass %. In particular, a Cu content of 1.5 mass % or less is favorable because it is then easy to hold the Cu solid solution content to 0.3 mass % or less.

(Fe: 0.3-1.0 Mass %)

Fe is an unavoidable impurity, and does not need to be added, but if present at 0.3 mass % or more, improves the high-temperature mechanical strength of the aluminum alloy, and when casting by die-casting, has the function of preventing sticking to the die, so 0.3 mass % or more may be added. This effect of Fe becomes pronounced when Fe is present at 0.4 mass % or more. However, when the Fe content becomes 0.6 mass % or more, the increase in Fe causes a loss in thermal conductivity and ductility, and when the amount of Fe exceeds 1.0 mass %, the thermal conductivity and plastic workability become inadequate.

((Fe Content)+(Mn Content)×2: 1.0 Mass % or Less)

While Mn is an unavoidable impurity, like Fe, it improves the high-temperature mechanical strength of aluminum alloys, and when casting by die-casting, prevents soldering of the die. Additionally, since Mn is prevalent in scrap from food and beverage cans, it is often unavoidably present, and a high tolerance for Mn is favorable for recycling, which has economical and environmental benefits. However, since Mn acts strongly to reduce thermal conductivity, its content must be limited such that the total amount of (Fe content)+(Mn content)×2 is 1.0 mass % or less.

(Mg: 0.1-0.6 Mass %)

Mg is an unavoidable impurity, and does not need to be added, but if present in an amount of 0.1 mass % or more, it has the function of improving the mechanical strength of aluminum alloys, as with Cu. Additionally, it forms Mg—Si compounds, and has the function of reducing the Si solid solution content in the matrix phase and improving the thermal conductivity, so 0.1 mass % or more may be added. Additionally, since Mg is prevalent in product scrap, a high tolerance for Mg is favorable for recycling, which has economical and environmental benefits. However, the increase in Mg reduces the thermal conductivity and ductility, so the amount should be limited to 0.6 mass % or less.

((Cu Content)+(Mg Content)×2.5+(Zn Content): 2.0 Mass % or Less)

Zn is an unavoidable impurity, but like Mg and Cu, has the function of improving the mechanical strength of aluminum. Additionally, since it is prevalent in product scrap, a high tolerance for Zn is favorable for recycling, which has economical and environmental benefits. However, since increased Zn reduces the thermal conductivity and ductility, its content must be limited such that the total amount of (Cu content)+(Mg content)×2.5+(Zn content) is 2.0 mass % or less.

(Unavoidable Impurities)

Since increases in impurities cause decreases in thermal conductivity, good thermal conductivity can be obtained by limiting unavoidable impurities to 0.1 mass % or less. In particular, Ti, Zr and V can profoundly affect thermal conductivity, so should be limited to 0.05 mass % or less to obtain good thermal conductivity. Additionally, good thermal conductivity can be obtained by holding Mn to 0.2 mass % or less and Zn to 0.5 mass % or less.

Furthermore, less than 0.3 mass % of Fe and less than 0.1 mass % of Mg can of course be tolerated as unavoidable impurities.

(Solution Treatment: at 450-520° C. for 1-10 Hours, Followed by Quenching)

By performing a solution treatment under the above conditions, the micro and macro level segregation that is often observed in casting materials can be relieved, thus reducing deviations in thermal conductivity and mechanical strength, promoting the formation of solid solution by having the crystal precipitates precipitated by phase transition during solidification and the precipitates precipitated by phase transformation during cooling dissolved into the matrix phase, causing precipitates composed of transition elements such as Fe and Mn precipitated in the supersaturated solid solution during ageing treatment to increase the thermal conductivity, and furthermore, spheroidizing the Si particles to improve the ductility and plastic workability. Quenching is performed by cooling at a rate of at least 100° C./sec to a temperature of 100° C. or less.

If the treatment temperature is less than 450° C., or the retention time is less than 1 hour, then the above effects are inadequate, while on the other hand, if the treatment temperature exceeds 520° C. or the retention time is more than 10 hours, then local fusion can occur, thus increasing the possibility of reduced strength. In order to obtain better solid solution treatment effects, the treatment temperature should preferably be a high temperature exceeding 500° C. If a solid solution treatment is not performed, then cooling should be performed at a rate of at least 100° C./sec to a temperature of 200° C. or less after casting.

(Ageing: at 160-370° C. for 1-10 Hours)

Due to the above ageing treatment, the Cu, Si, Mg and Zn supersaturated in solid solution in the matrix phase are precipitated out as Al—Cu, Mg—Si and Zn—Mg compounds, thus reducing the amount of Cu, Si, Mg and Zn in solid solution in the matrix phase, and improving the thermal conductivity of the alloy. Furthermore, by performing an ageing treatment, casting strain and macrosegregation of Si can be eliminated, thereby improving the thermal conductivity. Additionally, intermediaries of the above compounds improve the mechanical strength of the alloy. With ageing conditions of at the temperature of 160° C. or less or for 1 hour or less, the effect of precipitation is small, so the increase in thermal conductivity and mechanical strength is small. On the other hand, if the holding temperature is exceeded 370° C. or holding time is exceeded 10 hours, over-ageing progresses, thus causing much greater reductions in strength. Additionally, when produced by normal die-casting, gas that is trapped inside can cause blisters to form. As with the alloy composition, the heat treatment conditions may be selected based on the desired thermal conductivity and strength properties, or in consideration of the limitations on industrial production, but when considering the balance between thermal conductivity and strength, should be within the range of at 180-300° C. for 4-8 hours in view of the balance between thermal conductivity and strength.

EXAMPLES

Examples of the present invention shall be described below.

Example 1

An aluminum alloy with the composition shown in Table 1 was cast by means of a pore-free die-casting process, to obtain a plate-shaped casting. The thermal conductivity, mechanical strength (tensile strength) and Cu solid solution content of the resulting casting were measured. The results are shown in Table 2. Next, the casting was held at 220° C. for 4 hours, in an ageing treatment. The results are shown in Table 2.

TABLE 1

| Sample Composition | | | | | | | | | |
|---|---|---|---|---|---|---|---|---|---|
| Alloy No. | Si | Cu | Fe | Mn | Mg | Zn | Fe + Mn × 2 | Cu + Mg × 2.5 + Zn | |
| 1 | 10.0 | 1.2 | — | — | — | — | — | 1.2 | Invention Example |
| 2 | 10.0 | 1.2 | 0.5 | 0.2 | — | — | 0.9 | 1.2 | Invention Example |
| 3 | 10.0 | 1.2 | 0.5 | 0.1 | 0.2 | 0.2 | 0.7 | 1.9 | Invention Example |
| 4 | 10.0 | 0.5 | 0.5 | — | — | — | 0.5 | 0.5 | Invention Example |
| 5 | 10.0 | 1.9 | 0.5 | — | — | — | 0.5 | 1.9 | Invention Example |
| 6 | 10.0 | 0.1 | 0.5 | — | — | — | 0.5 | 0.1 | Invention Example |
| 7 | 10.0 | 2.5 | 0.6 | — | — | — | 0.6 | 2.5 | Comparative Example |
| 8 | 10.0 | 1.2 | 0.6 | 0.3 | 0.2 | 0.2 | 1.2 | 1.9 | Comparative Example |
| 9 | 10.0 | 1.2 | 0.5 | 0.1 | 0.4 | 0.2 | 0.7 | 2.4 | Comparative Example |
| 10 | 10.0 | — | 0.5 | — | — | — | 0.5 | 0.0 | Comparative Example |
| 11 | 11.5 | 2.4 | 0.8 | 0.3 | 0.2 | 0.8 | 1.4 | 3.7 | ADC12 |

(units: mass %)
* "—" means less than 0.05 mass %

TABLE 2

| Effects of Ageing Treatment | | | | | | | |
|---|---|---|---|---|---|---|---|
| | Before Ageing | | | After Ageing | | | |
| Alloy No. | Tensile str. | Thermal cond. | Cu sol. | Tensile str. | Thermal cond. | Cu sol. | |
| 1 | 225 | 145 | 0.55 | 250 | 161 | 0.10 | Invention Example |
| 2 | 230 | 137 | 0.49 | 255 | 153 | 0.08 | Invention Example |
| 3 | 250 | 135 | 0.51 | 270 | 155 | 0.09 | Invention Example |
| 4 | 190 | 140 | 0.32 | 210 | 159 | 0.07 | Invention Example |
| 5 | 240 | 135 | 0.61 | 260 | 151 | 0.12 | Invention Example |
| 6 | 190 | 150 | 0.08 | 176 | 165 | 0.02 | Invention Example |
| 7 | 250 | 132 | 0.71 | 270 | 148 | 0.15 | Comparative Example |
| 8 | 230 | 129 | 0.52 | 250 | 142 | 0.10 | Comparative Example |
| 9 | 250 | 129 | 0.55 | 275 | 148 | 0.09 | Comparative Example |
| 10 | 180 | 151 | — | 170 | 165 | — | Comparative Example |
| 11 | 265 | 115 | 0.70 | 290 | 130 | 0.13 | ADC12 |

(Units of thermal conductivity: $\lambda/w \cdot m^{-1} \cdot k^{-1}$; units of tensile strength: σB/MPa)
* "—" means less than 0.01 mass %

Table 2 shows that subjecting the aluminum alloys (alloys 1-6) with the compositions of the present invention to an ageing treatment raises their thermal conductivity and tensile strength. This is because the ageing treatment caused the Cu, Mg, Si and Zn dissolved in the matrix phase and suppressing the thermal conductivity to precipitate out as Al—Cu, Mg—Si and Mg—Zn compounds, thereby reducing the solid solution content of those elements, especially Cu, and also because the ageing treatment eliminated casting strain and macrosegregation of Si. Additionally, in the aluminum alloys (alloys 7-11) excluded from the compositions of the present invention, the ageing treatment improved the thermal conductivity, but did not result in adequate thermal conductivity for use as a heat exchange element such as a heat sink. The aluminum alloy (alloy 10) not containing Cu had adequate thermal conductivity but low mechanical strength.

Example 2

Aluminum alloys with compositions according to the following Table 3 were cast by a pore-free die-casting process into a finned test piece having a tip of R 0.5 m and a height of 20 mm, and a round rod of 20φ, and the number of fin filling defects among 100 castings was counted. Additionally, the width of flank wear when cutting the round rods with superhard cutting tools was measured. The results were as shown in Table 3.

TABLE 3

| Sample Compositions and Casting/Cutting Test Results | | | | | | | | |
|---|---|---|---|---|---|---|---|---|
| Alloy No. | Si | Cu | Fe | Mn | Fill Def. % | Solder Def. % | Flank Wear mm | |
| 3 | 10.0 | 1.2 | 0.5 | 0.1 | 2 | 2 | 0.1 | Invention Example |
| 12 | 6.9 | 1.2 | 0.5 | 0.1 | 18 | 5 | 0.1 | Comparative Example |
| 13 | 13.0 | 1.2 | 0.5 | 0.1 | 1 | 1 | 0.3 | Comparative Example |
| 14 | 10.0 | 1.2 | 0.2 | — | 5 | 22 | 0.1 | Comparative Example |

(Alloy composition units: mass %)

The above results show that when the Si content is low, filling defects occur at thin portions. This is because the fluidity of the melt is reduced. On the other hand, when the Si content is high, the flank surface wear width of cutting tools increases. This is because the primary Si particles promote tool wear. Additionally, if the Fe content is low, then soldering defects will increase.

Example 3

An aluminum alloy of the composition of alloy 3 described in Example 1 was cast by a normal die-casting process, to obtain plate-shaped castings. These castings were held at temperatures of at 140° C., 180° C., 350° C. and 400° C. for 4 hours each, and their thermal conductivity, mechanical strength and Cu solid solution content were measured. Additionally, their specific gravity before and after heat treatment was measured, and blistering rate computed therefrom. The results are shown in Table 4.

TABLE 4

Ageing Temperature and Properties

| Ageing Temperature | Thermal Conductivity | Tensile Strength | Cu Solid Solution | Blistering Rate | |
|---|---|---|---|---|---|
| 140° C. | 140 | 260 | 0.42 | <0.2 | Comparative Example |
| 180° C. | 151 | 290 | 0.25 | 0.2 | Invention Example |
| 350° C. | 163 | 210 | 0.06 | 0.4 | Invention Example |
| 400° C. | 162 | 165 | 0.10 | 1.5 | Comparative Example |

(Units of thermal conductivity: $\lambda/w \cdot m^{-1} \cdot k^{-1}$; units of tensile strength: σB/MPa)

The above results show that the sample that was held at a temperature of 140° C. for 4 hours had a higher thermal conductivity and tensile strength, but the sample that was held at a temperature of 180° C. for 4 hours had a lower thermal conductivity and tensile strength. This is because the precipitation was insufficient due to the low ageing temperature, as a result of which the solid solution content of elements other than Al in the matrix phase was not very low. On the other hand, the sample that was held at a temperature of 400° C. for 4 hours had a higher thermal conductivity, but a much lower tensile strength. This is due to over-ageing. Additionally, the blistering rate was high, so there was also a considerable influence from internal defects.

Example 4

An aluminum alloy of the composition of alloy 3 described in Example 1 was cast by a normal die-casting process, to obtain plate-shaped castings. These castings were held at temperatures of 430° C., 500° C., and 550° C. for 2 hours each to perform three types of solution treatments, quenched to cool to standard temperature, then aged by holding at a temperature of 220° C. for 4 hours. Then, the thermal conductivity and tensile strength were measured. The results are shown in the following Table 5.

TABLE 5

Properties after Solution Treatment

| Sol. Treatment Temperature | Thermal conductivity | Tensile strength | |
|---|---|---|---|
| 430° C. | 156 | 270 | Comparative Example |
| 500° C. | 160 | 290 | Invention Example |
| 550° C. | 156 | 220 | Comparative Example |

(Units of thermal conductivity: $\lambda/w \cdot m^{-1} \cdot k^{-1}$; units of tensile strength: σB/MPa)

Table 2 and the results from the above Table 5 show that the sample that was subjected to a solution treatment retained for at a temperature of 430° C. for 2 hours had roughly the same values as a sample that was not subjected to a solution treatment. This is because the solution treatment temperature was low, and the solution treatment was therefore inadequate. The sample subjected to a solution treatment at 550° C. had a somewhat higher thermal conductivity, but the tensile strength was lower. This is because local melting occurred during the solution treatment. On the other hand, the sample subjected to a solution treatment at 500° C. had improved thermal conductivity and tensile strength.

The invention claimed is:

1. A manufacturing method of an aluminum alloy material for use in a thermal conduction application, comprising casting an aluminum alloy with the composition consisting of 10.0 to 12.5 mass % of Si, 0.1 to 1.2 mass % of Cu, less than 0.05 mass % of Mg as an impurity, less than 0.05 mass % of Ti as an impurity, and Al and unavoidable impurities as the remainder, wherein a total amount of unavoidable impurities is 0.1 mass % or less, and an amount of Fe as an unavoidable impurity is less than 0.05 mass %, subsequently cooling the aluminum alloy cast at a rate of at least 100° C./sec to a temperature of 200° C. or less without solid solution treatment, and subjecting the aluminum alloy cast to an ageing treatment within the range of at 220-300° C. for 4-8 hours as T5 temper.

2. A manufacturing method of an aluminum alloy material for use in a thermal conduction application, comprising casting an aluminum alloy with the composition consisting of 10.0 to 12.5 mass % of Si, 0.1 to 1.2 mass % of Cu, at least 0.3 mass % of Fe, less than 0.05 mass % of Mg as an impurity, less than 0.05 mass % of Ti as an impurity, and Al and unavoidable impurities as the remainder, wherein the relationship between the Fe content and the content of Mn included as an unavoidable impurity is such that the total of (Fe content)+(Mn content) times 2 is 1.0 mass % or less by a pore-free die casting process, and subjecting the aluminum alloy cast by the pore-free die casting process to an ageing treatment within the range of at 220-300° C. for 4-8 hours as T5 temper.

* * * * *